US007284832B2

(12) United States Patent
Kang

(10) Patent No.: US 7,284,832 B2
(45) Date of Patent: Oct. 23, 2007

(54) INK CARTRIDGE UNIT AND INKJET PRINTER HAVING THE SAME

(75) Inventor: Sung-Sook Kang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 266 days.

(21) Appl. No.: 11/049,994

(22) Filed: Feb. 4, 2005

(65) Prior Publication Data

US 2005/0179753 A1 Aug. 18, 2005

(30) Foreign Application Priority Data

Feb. 12, 2004 (KR) ..... 10-2004-0009173
Dec. 21, 2004 (KR) ..... 10-2004-0109161

(51) Int. Cl.
*B41J 2/14* (2006.01)

(52) U.S. Cl. ..... 347/50

(58) Field of Classification Search ..... 347/49, 347/50, 58; 439/66, 67, 492, 493
See application file for complete search history.

(56) References Cited

U.S. PATENT DOCUMENTS 4,706,097 A * 11/1987 Harmon ..... 346/139 C
4,907,018 A * 3/1990 Pinkerpell et al. ..... 346/139 R
5,461,482 A * 10/1995 Wilson et al. ..... 347/50
5,835,111 A 11/1998 Balazer et al.
5,971,525 A 10/1999 Inoue et al.
6,396,665 B1 5/2002 Asano ..... 360/264.2
6,431,684 B1 * 8/2002 Olsen ..... 347/50
6,536,872 B2 * 3/2003 Goin et al. ..... 347/50
2003/0035026 A1 2/2003 Goin et al.

FOREIGN PATENT DOCUMENTS

| | | |
|---|---|---|
| CN | 1347806 | 5/2002 |
| EP | 0 547 596 | 6/1993 |
| EP | 0 622 233 | 11/1994 |
| EP | 1 199 169 | 4/2002 |
| KR | 1998-072496 | 11/1998 |
| KR | 100186587 | 12/1998 |
| WO | WO 96/05061 | 2/1996 |

* cited by examiner

*Primary Examiner*—Anh T. N. Vo
(74) *Attorney, Agent, or Firm*—Roylance, Abrams, Berdo & Goodman, L.L.P.

(57) ABSTRACT

An ink cartridge unit for reducing material costs and enhancing reliability. The ink cartridge unit including an ink cartridge having at least one head chip to eject ink stored in the ink cartridge according to printing data. A drive substrate having a circuit pattern, and a head cable connected with the drive substrate and capable of signal-communicating with the drive substrate. Thus, the printing data received by the drive substrate is transmitted to the head chip.

16 Claims, 7 Drawing Sheets

INK CARTRIDGE UNIT AND INKJET PRINTER HAVING THE SAME

CROSS-REFERENCE TO RELATED APPLICATIONS

This application claims the benefit under 35 U.S.C. § 119(a) of Korean Patent Application Nos. 2004-9173 and 2004-109161, filed on Feb. 12, 2004 and Dec. 21, 2004, respectively, the entire contents of which are hereby incorporated by reference.

BACKGROUND OF THE INVENTION

1. Field of the Invention

The present invention relates to an image forming apparatus having a simplified arrangement for improved transmission of printing data. More particularly, the present invention relates to an inkjet printer having a head cable capable of improved signal-communication with a drive substrate to transmit printing data from the drive substrate to a head chip.

2. Description of the Related Art

Inkjet printers may be classified into shuttle type ink jet printers and array type inkjet printers. Shuttle type ink jet printers execute print while transferring one chip. Array type inkjet printers execute print in high speed using a plurality of of chips.

The shuttle and array type inkjet printers both eject ink onto a print medium according to printing data transmitted from a host such as a computer to the head chip(s) thereof, thereby forming an image. A conventional arrangement for transmitting printing data is shown in FIG. 1.

Referring to FIG. 1, a first cable 10, a drive substrate 20, a second cable 30 and a head cable 40 are typically used to transmit the printing data as described above to a head chip 35 on an ink cartridge 60.

The first cable 10 is electrically connected at one end thereof to a main board (not shown) of an inkjet printer. The main board receives printing data from a host such as a computer to transmit the printing data from the main board to the drive substrate 20. The printing data received by the drive substrate 20 is transmitted to the second cable 30 and the printing data received by the second cable 30 is transmitted to the head chip 35 of the ink cartridge 60 via the head cable 40. Then, the head chip 35 ejects ink onto a print medium according to the transmitted printing data, thereby forming an image.

With the above-mentioned arrangement for transmitting a series of printing data, the head cable 40 is attached to the rear and bottom sides of the ink cartridge 60. The second cable 30 is directly contacted with the head cable 40 for establishing an electrical connection. In addition, in order to enhance the contact capability between the second cable 30 and the head cable 40, an elastic member 50 for compressing the second cable 30 is interposed between a carrier 70 of the ink cartridge 60 and the second cable 30.

However, because the above-mentioned arrangement to transmit printing data is complicated in construction, the path of transmitting printing data is also complicated, thus there is a disadvantage in that the risk of losing printing data is increased.

Meanwhile, the elastic member 50 is fixed to a side of a printer body. Thus, the printer may be unavailable if the elastic member 50 is hardened due to repeated use or long-term use thereof. Accordingly, a disadvantage is that the life span of the printer may be shortened.

Accordingly, there is a continual need for an improved image forming apparatus having a simplified arrangement to transmit printing data to a head chip. The simplified arrangement improves contact between the head cable and a drive substrate to prevent loss of printing data.

SUMMARY OF THE INVENTION

Accordingly, aspects of the present invention are to solve at least the above problems and/or disadvantages and to provide at least the advantages described below. Therefore, an object of the present invention is to provide an ink cartridge unit that reduces the number of components and simplifies the construction of the ink cartridge unit and an inkjet printer having the same.

Another object of the present invention is to provide an inkjet printer with increased reliability.

Still another object of the present invention is to provide an inkjet printer with a prolonged life span.

In order to achieve the above-mentioned objects, there is provided an ink cartridge unit comprising an ink cartridge having a head chip to eject ink stored in the ink cartridge according to printing data. A drive substrate has a circuit pattern, and a head cable is connected with the drive substrate. The head cable is capable of signal-communicating with the drive substrate. Thus, the printing data received by the drive substrate is transmitted to the head chip.

Meanwhile, according to another aspect of the present invention, there is also provided an inkjet printer comprising a printer body, a drive substrate arranged on the printer body to receive printing data, and an ink cartridge for storing ink. The ink cartridge has a head chip to eject ink stored in the ink cartridge onto a print medium according to the printing data. A head cable is connected to the drive substrate and capable of signal-communicating with the drive substrate. Thus, the printing data received by the drive substrate is transmitted to the head chip.

According to another embodiment of the present invention, the ink cartridge unit or the inkjet printer further comprises an elastic member for compressing the head cable and the drive substrate into elastic contact with each other. The elastic member is interposed between the head cable and the ink cartridge. Meanwhile, the head cable is provided with a plurality of first projections on a side facing the drive substrate. The elastic member is provided with a plurality of second projections corresponding to the first projections on a side facing the head cable. In addition, it is preferable that the first and second projections are dome-shaped and the elastic member is made of rubber material.

According to still another embodiment of the present invention, the head cable is provided with a plurality of elastic domes on a side facing the drive substrate. Thus, the head cable and the drive substrate elastically contact each other. The elastic domes are preferably steel domes.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 2:
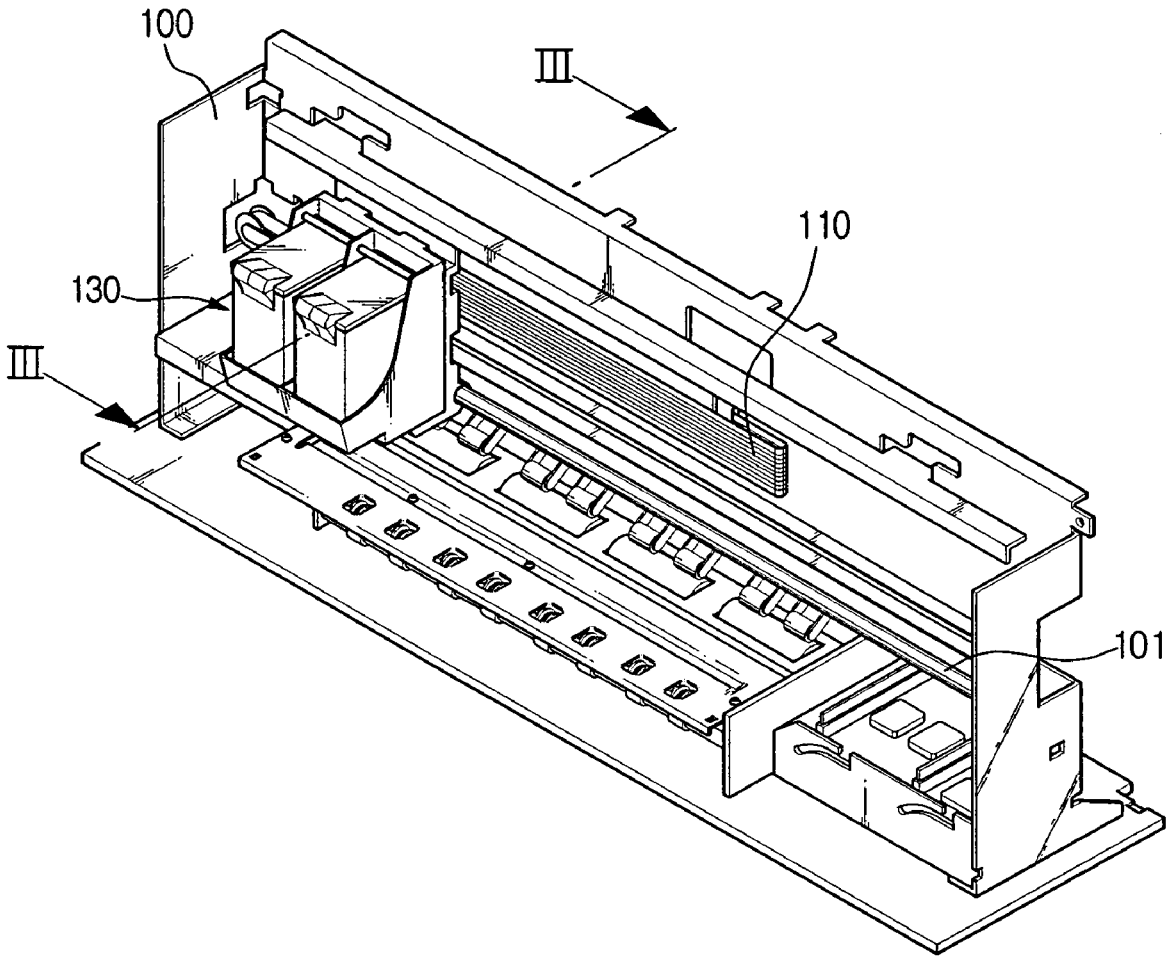
FIG. 2 is a perspective view schematically showing a shuttle type inkjet printer, in accordance with an aspect of the present invention.
Figure 3:
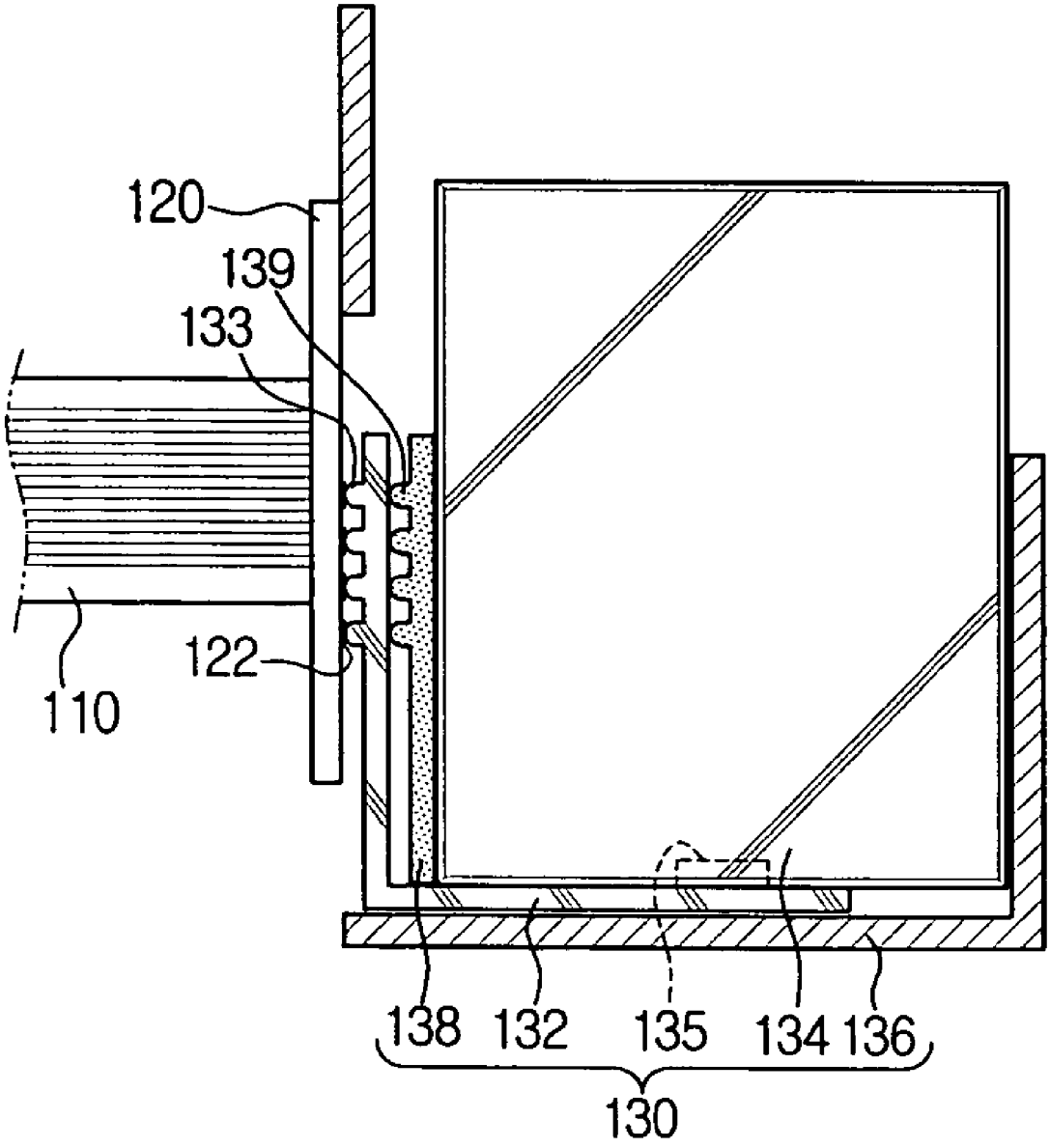
FIG. 3 is a cross-sectional view taken along line III-III of FIG. 2.

Referring to FIGS. 2 and 3, the inkjet printer according to an embodiment of the present invention comprises a printer body 100, a transfer shaft 101, a first cable 110, a drive substrate 120 and an ink cartridge unit 130.

The printer body 100 is provided with various parts for forming an image within the printer body 100.

The transfer shaft 101 is secured to the printer body 100 at opposite ends thereof to guide left and right movement of the cartridge unit 130.

The first cable 110 may be constituted by a flexible printed circuit (FPC) and electrically connected at one end thereof to a main board (not shown) installed within the printer body 100. In addition, the other end of the first cable 110 is connected to the drive substrate 120. In the present embodiment, although the first cable 110 is illustrated as being connected to the main board, the drive substrate 120 may also serve as a main board in an array type inkjet printer. In that case, the first cable 110 would be directly connected to a host such as a computer.

The drive substrate 120 is formed with a circuit pattern. A plurality of contact pads 122 within the circuit of the drive substrate 120 are externally exposed on one side of the drive substrate 120 so that the ink cartridge unit 130 can be electrically connected to the drive substrate 120. The drive substrate 120 separates printing data transmitted through the first cable 110 in more detail and amplifies data signals.

The ink cartridge unit 130 comprises a head cable 132, an ink cartridge 134, an ink cartridge carrier 136 and an elastic member 138.

The head cable 132 is fixed to the bottom side of the ink cartridge 134 so that one end thereof is electrically connected to the drive substrate 120. The other end is electrically connected to the head chip 135 of the ink cartridge 134. Head cable 132 may also constitute an FPC, as with the first cable 110. In addition, a plurality of first projections 133 corresponding to the contact pads 122 are formed on the side of the head cable 132 facing the drive substrate 120. Further, the first projections 133 are in direct contact with the contact pads 122 of the drive substrate 120. Thus, the drive substrate 120 and the head cable 132 are electrically connected with each other.

The ink cartridge 134 stores ink. The ink cartridge 134 is provided with a head chip 135 on the bottom side thereof to eject ink according to printing data transmitted through the head cable 132. Thus, the ink stored in the ink cartridge 134 is ejected by the head chip 135 onto a print medium according to the printing data, thereby forming an image.

The ink cartridge carrier 136 removably houses the ink cartridge 134. In a shuttle type inkjet printer, the ink cartridge carrier 136 moves the ink cartridge 134 left and right along the transfer shaft 101 at the time of printing.

The elastic member 138 is fixed to the rear side of the ink cartridge 134 so that it may compress the head cable 132 against the drive substrate 120. The elastic member 138 may be formed from elastic rubber. In addition, a plurality of the second projections 139 are formed on the side of the elastic member 132 facing the head cable 132. The plurality of second projections 139 correspond to the first projections 133, so that the contact pads 122, the first projections 133 and the second projections 149 are formed in the same number. Due to the second projections 139, compressive pressure is concentrated to the first projections 133 of the head table 132. Thus, the first projections 133 and the contact pads 122 may more effectively contact each other. Further, the first and second projections 133, 139 are preferably dome-shaped, so that the first projections 133 may more stably contact the contact pads 122.

Now, the operation of the inkjet printer constructed as above will be described in more detail.

If a print demand is produced from a host, corresponding printing data is transmitted to the drive substrate 120 through the first cable 110. Then, the drive substrate 120 amplifies and separates in more detail the transmitted data. Next, the amplified and separated data is transmitted to the head cable 132 through the first projections 133 contacted with the contact pads 122. The printing data transmitted to the head cable 132 is transmitted to the head chip 135; the head chip 135 ejects ink stored in the ink cartridge 134 onto a print medium according to the printing data.

Figure 1:
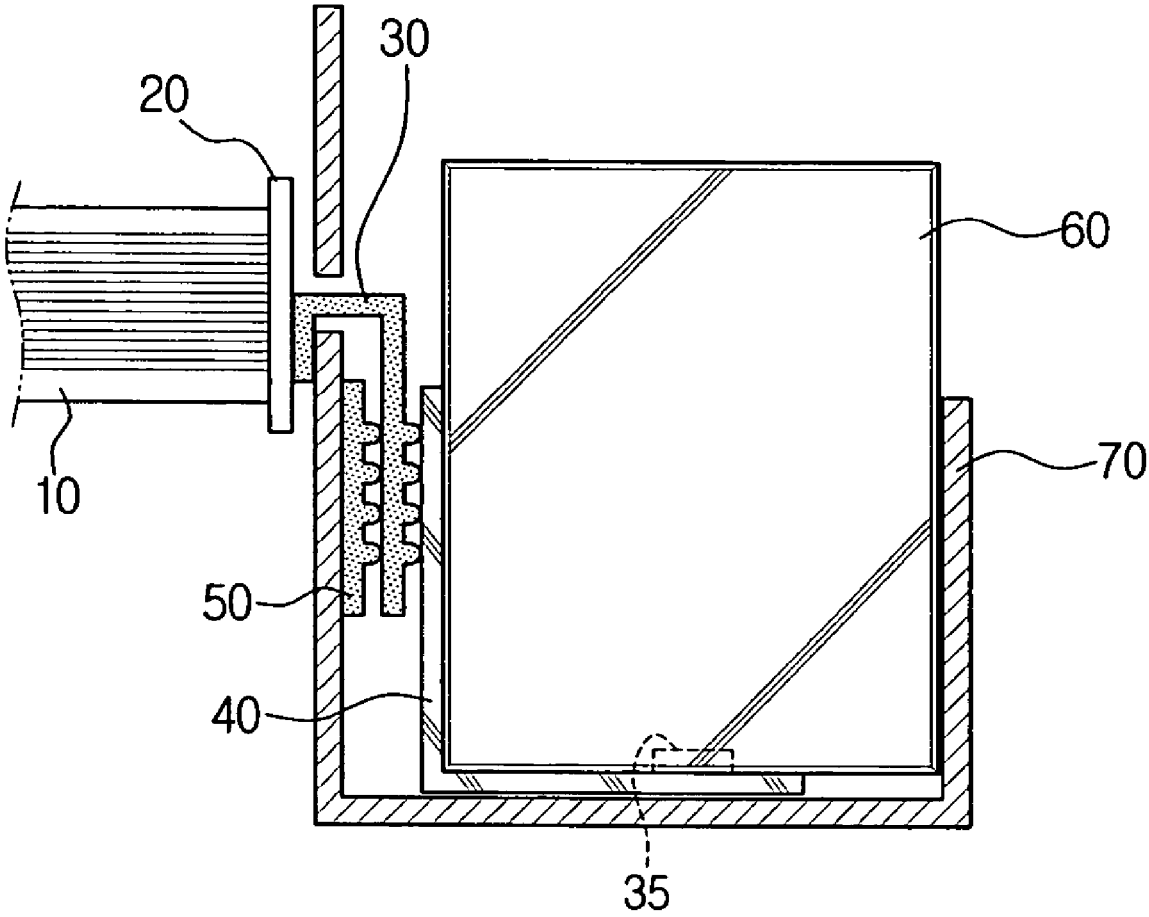
FIG. 1 is a cross-sectional view showing a contact arrangement between a drive substrate and a head cable of a conventional inkjet printer.

The above-mentioned inkjet printer is not provided with the existing second cable 30, as seen in FIG. 1. Therefore, the number of parts used is reduced. In addition, because the path of transmitting printing data may be shortened, the data may be more stably transmitted. Meanwhile, because the elastic member 138 is attached to an exchangeable ink cartridge 134, it is possible to repair the printer in a simple manner by exchanging the ink cartridge unit 130 when the elastic member 138 is hardened. Thus, the life span of the printer may be prolonged.

Figure 4A:
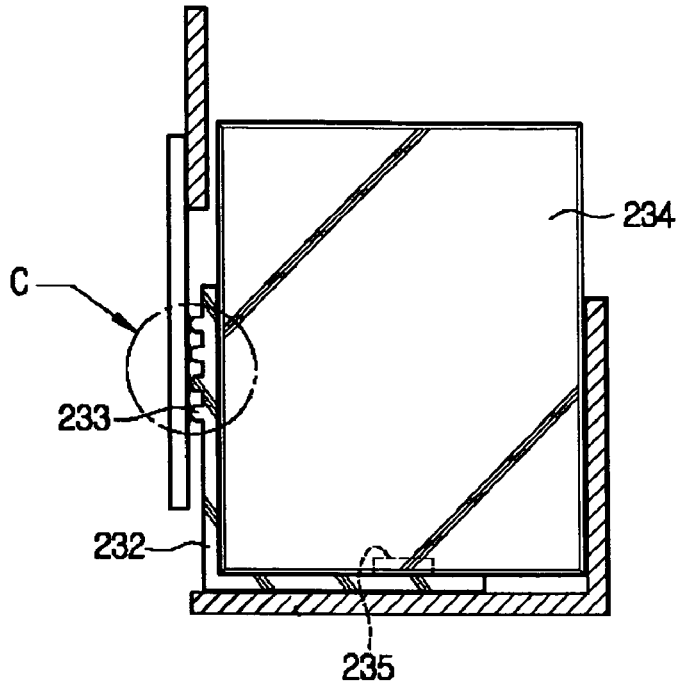
FIG. 4A is a cross-sectional view schematically showing a main part of an inkjet printer according to another embodiment of the present invention.
Figure 4B:
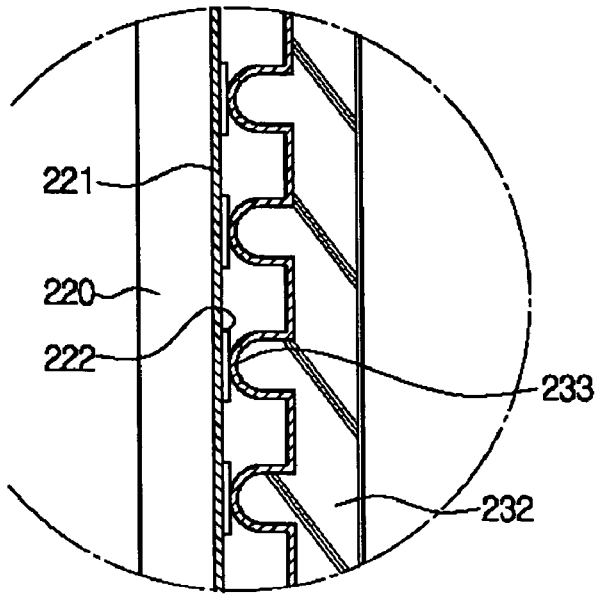
FIG. 4B shows part C of FIG. 4A in detail.

FIGS. 4A and 4B are cross-sectional views schematically showing a main part of an ink printer according to another embodiment of the present invention.

Referring to FIGS. 4A and 4B, elastic domes 233 are formed on the head cable 232, instead of the elastic member 138. The elastic domes 233 have suitable elasticity to return to their original dome shape after an external force is removed, even if they are deformed by an external force. Preferably, the elastic domes 233 are similar to steel elastic terminals of a charger for a portable telephone. However, the elastic domes 233 are not limited to steel domes and any member capable of mutually communicating and having elasticity may be employed.

Elastic domes 233 come into contact with the drive substrate 220 in a compressed state while the ink cartridge 230 is mounted. Accordingly, the head cable 232 may elastically contact the drive substrate 220. More particularly, the elastic domes 233 come into compressive contact with the contact pads 222 electrically connected with the circuit pattern 221 on the drive substrate 220, whereby signal communication to the head chip 235 are enabled. The construction of such a circuit pattern 221 is well-known in the art and thus description thereof is omitted.

The inkjet printer constructed as mentioned above is operated in the following manner.

Printing data received by the drive substrate 220 is transmitted to the head chip 235 of the ink cartridge 234 through the elastic domes 233 and the head cable 232. The construction and functional action of this embodiment are the same as those of the embodiment of FIG. 2. Therefore, detailed description thereof is omitted.

The inkjet printer constructed as mentioned above is not provided with a second cable 30 and an elastic member 50, 138 as with the components in a conventional inkjet printer. Therefore, not only are the material costs reduced, but the stability and reliability of the resultant product is enhanced due to the shortened path for transmitting printing data.

Figure 5:
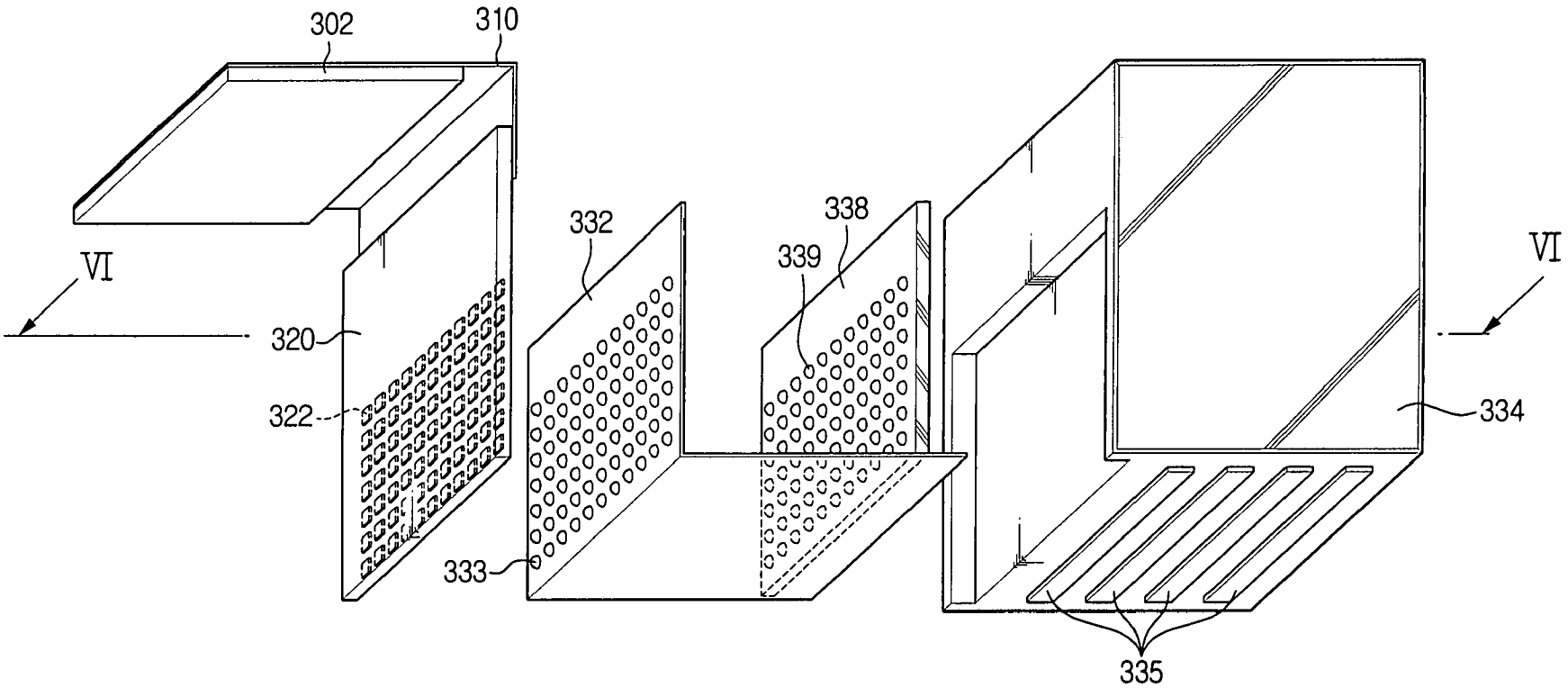
FIG. 5 is an exploded perspective view schematically showing a main part of an array type inkjet printer in accordance with an aspect of the present invention.

FIG. 5 is an exploded perspective view schematically showing a main part of an array type inkjet printer to which an aspect of the present invention is applied, and FIG. 5 is a cross-sectional view taken along line VI-VI.

Figure 6:
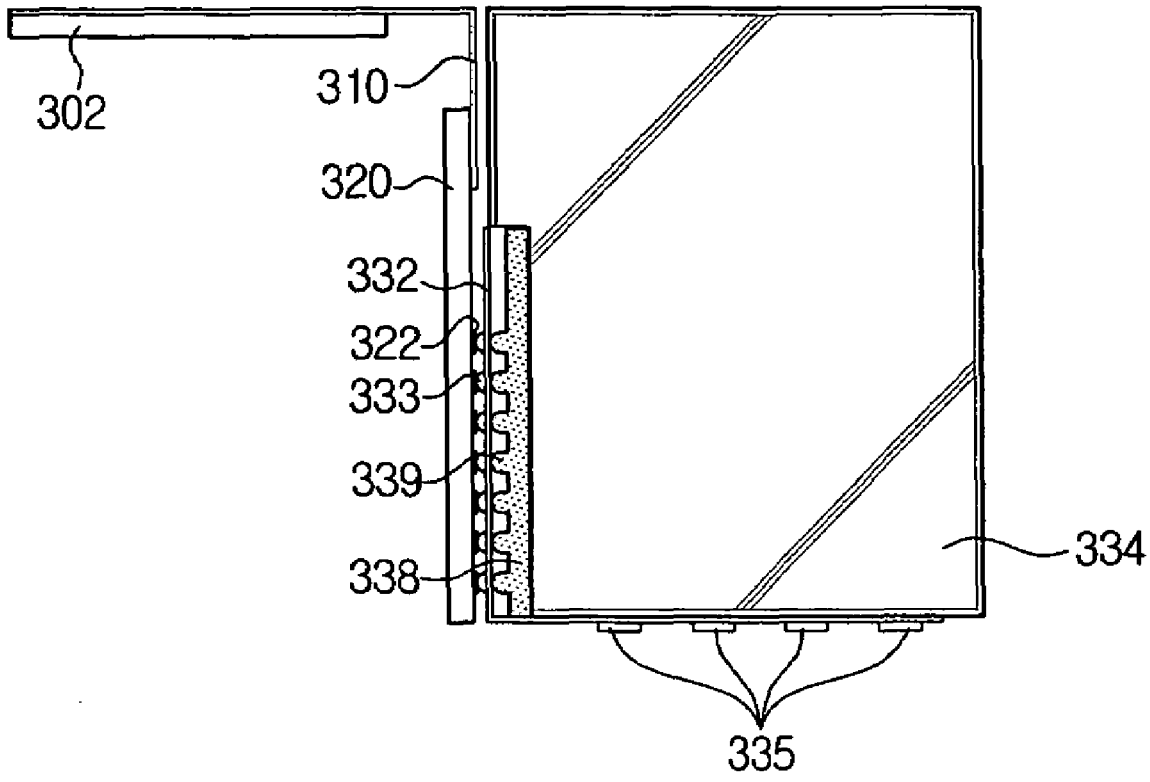
FIG. 6 is a cross-sectional view taken along line VI-VI of FIG. 5.

Referring to FIGS. 5 and 6, the array type inkjet printer is provided with a plurality of head chips 335 for the colors yellow, magenta, cyan and black on the bottom of an ink cartridge 334. In addition, a head cable 332 is fixed at one end thereof to the bottom side of the ink cartridge 334. Thus, the cable 332 may be electrically connected to the head chips 335. The other end of the head cable 332 is provided with a plurality of first projections 333. The first projections 333 come into contact with contact pads 322 provided on a side of a contact board 320, which is an example of a drive substrate 320. Meanwhile, an elastic member 338 is interposed between the head cable 332 and the ink cartridge 334. One side of the elastic member 338 is provided with a plurality of second projections 339 corresponding to the first projections 333, thereby making the first projections 333 compressively contact with the contact pads 322. Then, the contact board 320 is electrically connected with a main board 302 by the first cable 310, and the main board 302 receives printing data transmitted from a host.

Figure 7:
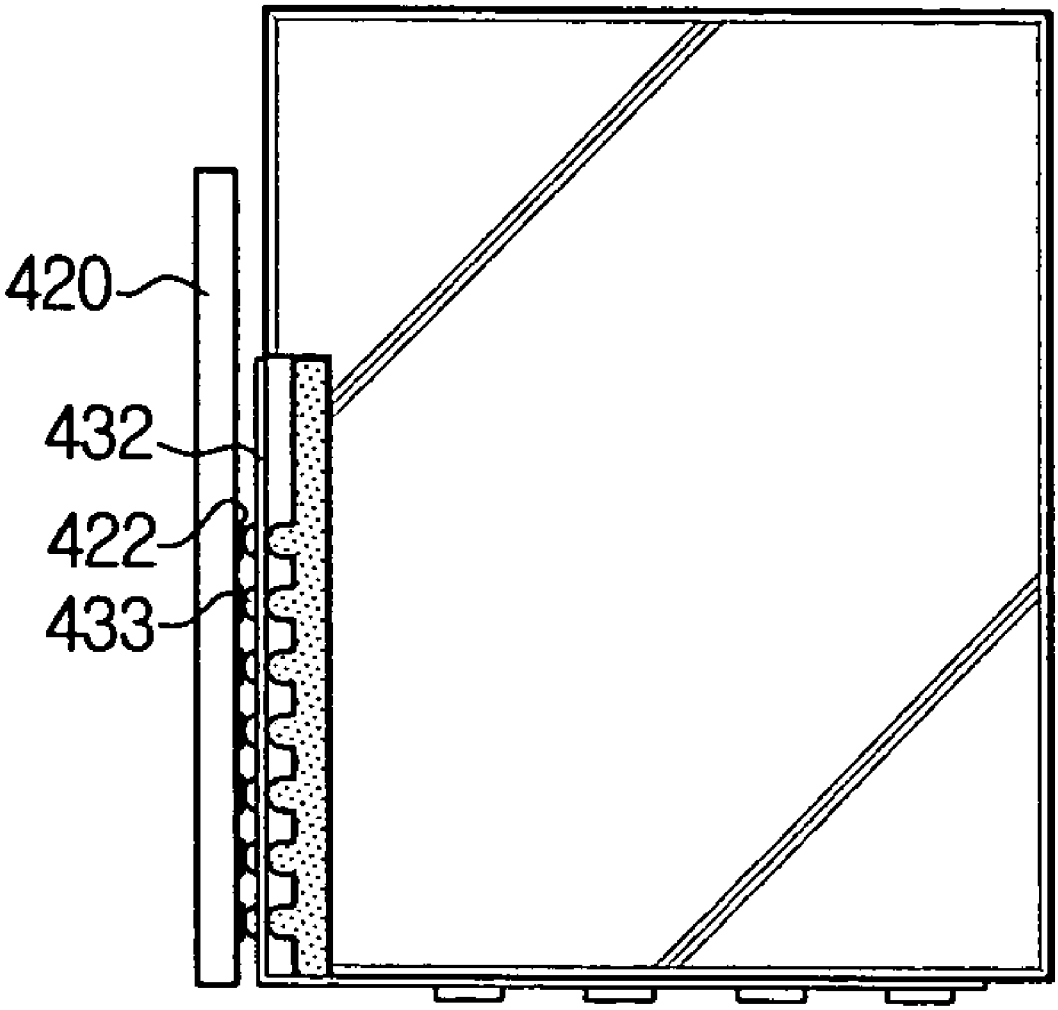
FIG. 7 is a cross-sectional view schematically showing an arrangement in which a main board and a head cable of an array type inkjet printer are directly contacted with each other.

FIG. 7 is a cross-sectional view showing another form of an embodiment of the present invention employing a main board 420 as an example of the drive substrate. Referring to FIG. 7, a plurality of contact pads 422 are formed on the main board 420. The first projections 433 formed on the head cable 432 come into contact with the contact pads 422.

As described above, the inventive contact arrangement of a head cable and a drive substrate may identically apply to an array type inkjet printer by changing the size of the head cable and the drive substrate and the number of the contact points. Although FIGS. 5 to 7 shows only one example to which the embodiment of the present invention of FIG. 3 is applied, the other embodiment of FIGS. 4A and 4B may be identically applied to such an array type inkjet printer.

As described above, and in accordance with aspects of the present invention, it is possible to save material costs because the number of parts can be reduced by omitting a second cable and an elastic member needed in the prior art.

In addition, because the path of transmitting printing data can be reduced, it is possible to reduce the risk of losing printing data. Thus, the resultant product is enhanced in stability and reliability.

Moreover, when the elastic member for compressing the head cable is hardened, it is possible to repair the printer in a simple manner by replacing the ink cartridge unit, and the life span of the printer may be prolonged.

While the invention has been shown and described with reference to certain embodiments thereof, it will be understood by those skilled in the art that various changes in form and details may be made therein without departing from the spirit and scope of the invention as defined by the appended claims.

What is claimed is:

1. An ink cartridge unit comprising:

an ink cartridge having a head chip to eject ink stored in the ink cartridge according to printing data;

a drive substrate having a circuit pattern; and a head cable physically connected to the drive substrate so that the printing data is receivable by the drive substrate, and transmittable to the head chip; and an elastic member interposed between the head cable and the ink cartridge, so that the head cable is elastically compressed to contact the drive substrate.

2. An ink cartridge unit as claimed in claim 1, wherein the head cable is provided with a plurality of first projections on a side facing the drive substrate, and the elastic member is provided with a plurality of second projections corresponding to the first projections on a side facing the head cable.

3. An ink cartridge unit as claimed in claim 2, wherein the elastic member is made of rubber material.

4. An ink cartridge unit as claimed in claim 1, wherein the head cable is provided with a plurality of elastic domes on a side facing the drive substrate; so that the head cable elastically compresses and contacts the drive substrate; and wherein the elastic domes are steel domes.

5. An inkjet printer comprising:

a printer body;

a drive substrate arranged on the printer body to receive printing data;

an ink cartridge for storing ink with at least one head chip to eject ink stored in the ink cartridge onto a print medium according to the printing data;

a head cable physically connected with the drive substrate so that the printing data is receivable by the drive substrate, and transmittable to the at least one head chip; and an elastic member interposed between the head cable and the ink cartridge, so that the head cable is elastically compressed and contacts the drive substrate.

6. An inkjet printer as claimed in claim 5, wherein the head cable is provided with a plurality of first projections on a side facing the drive substrate, and the elastic member is provided with a plurality of second projections corresponding to the first projections on a side facing the head cable.

7. An inkjet printer as claimed in claim 6, wherein the elastic member is made of rubber material.

8. An inkjet printer as claimed in claim 5, wherein the head cable is provided with a plurality of elastic domes on a side facing the drive substrate; so that the head cable is elastically compressed and contacts with the drive substrate; and wherein the elastic domes are steel domes.

9. An inkjet printer comprising:

a printer body having a transfer shaft;

an ink cartridge arranged to move along the transfer shaft, wherein the ink cartridge has a head chip to eject ink stored in the ink cartridge onto a print medium according to printing data;

a drive substrate arranged on the printer body to receive the printing data;

a head cable physically connected with the drive substrate so that the printing data is receivable by the drive substrate, and transmittable to the head chip; and an elastic member interposed between the head cable and the ink cartridge; so that the head cable is elastically compressed and contacts the drive substrate.

10. An inkjet printer as claimed in claim 9, wherein the head cable is provided with a plurality of first projections on a side facing the drive substrate, and the elastic member is provided with a plurality of second projections corresponding to the first projections on a side facing the head cable; and wherein the first and second projections are dome-shaped.

11. An inkjet printer as claimed in claim 9, wherein the head cable is provided with a plurality of elastic domes on a side facing the drive substrate; so that the head cable is elastically compressed and contacts the drive substrate; and wherein the elastic domes are steel domes.

12. An inkjet printer comprising:

a printer body;

an ink cartridge arranged on the printer body, wherein the ink cartridge has a plurality of head chips to eject ink stored in the ink cartridge onto a print medium according to printing data;

a drive substrate arranged on the printer body to receive the printing data;

a head cable physically connected to the drive substrate so that the printing data is receivable by the drive substrate, and transmittable to the head chips; and an elastic member interposed between the head cable and the ink cartridge, so that the head cable is elastically compressed and contacts the drive substrate.

13. An inkjet printer as claimed in claim 12, wherein the head cable is provided with a plurality of first projections on a side facing the drive substrate, and the elastic member is provided with a plurality of second projections corresponding to the first projections on a side facing the head cable; and wherein the first and second projections are dome-shaped.

14. An inkjet printer as claimed in claim 12, wherein the head cable is provided with a plurality of elastic domes on a side facing the drive substrate; so that the head cable is elastically compressed and contacts the drive substrate; and wherein the elastic domes are steel domes.

15. An inkjet printer as claimed in claim 12, further comprising:

a main board being connected to a host to signal-communicate; and a first cable connecting the main board and the drive substrate to each other to signal-communicate.

16. An inkjet printer as claimed in claim 12, wherein the drive substrate is a main board connected to a host to signal-communicate.

* * * * *